US006761150B2

(12) United States Patent
Zdroik

(10) Patent No.: US 6,761,150 B2
(45) Date of Patent: Jul. 13, 2004

(54) FUEL RAIL FLOW-FEED PULSE DAMPER

(75) Inventor: Michael J. Zdroik, Metamora, MI (US)

(73) Assignee: Millennium Industries Corp., Cass City, MI (US)

( * ) Notice: Subject to any disclaimer, the term of this patent is extended or adjusted under 35 U.S.C. 154(b) by 17 days.

(21) Appl. No.: 10/288,011

(22) Filed: Nov. 5, 2002

(65) Prior Publication Data

US 2004/0084028 A1 May 6, 2004

(51) Int. Cl.[7] ..... F02M 41/00
(52) U.S. Cl. ..... 123/456; 138/30
(58) Field of Search ..... 123/456, 447, 123/463, 468, 469, 198 D; 138/30

(56) References Cited

U.S. PATENT DOCUMENTS

| | | | | |
|---|---|---|---|---|
| 4,601,275 A | | 7/1986 | Weinand | |
| 4,649,884 A | | 3/1987 | Tuckey | |
| 4,922,958 A | * | 5/1990 | Lemp | 137/561 A |
| 4,955,409 A | * | 9/1990 | Tokuda et al. | 137/561 A |
| 5,080,069 A | | 1/1992 | Hudson, Jr. | |
| 5,311,850 A | * | 5/1994 | Martin | 123/456 |
| 5,505,181 A | | 4/1996 | McRae et al. | |
| 5,782,222 A | * | 7/1998 | Morris et al. | 123/456 |
| 5,803,051 A | * | 9/1998 | Stehr | 123/456 |
| 5,845,621 A | | 12/1998 | Robinson et al. | |
| 5,894,861 A | | 4/1999 | Lorraine | |
| 5,896,843 A | | 4/1999 | Lorraine | |
| 6,135,092 A | | 10/2000 | Schaenzer et al. | |
| 6,205,979 B1 | | 3/2001 | Sims, Jr. et al. | |
| 6,418,910 B1 | | 7/2002 | Nally et al. | |
| 2002/0043249 A1 | | 4/2002 | Lee et al. | |
| 2002/0108660 A1 | | 8/2002 | Braun et al. | |

FOREIGN PATENT DOCUMENTS

| | | |
|---|---|---|
| JP | 11-2164 A | 1/1999 |

* cited by examiner

*Primary Examiner*—Mahmoud Gimie
(74) *Attorney, Agent, or Firm*—Dykema Gossett PLLC

(57) ABSTRACT

A fuel rail is provided for delivering fuel to a plurality of fuel injectors for a reciprocating piston internal combustion engine. The fuel rail includes an inlet tube for receiving pressurized fuel having at least one orifice. An outer tube forming and enclosing control volume is provided about the inlet tube. The outer tube has a plurality of injector outlets.

23 Claims, 2 Drawing Sheets

FUEL RAIL FLOW-FEED PULSE DAMPER

FIELD OF THE INVENTION

The field of the present invention is fuel rails for internal combustion engines and in particular, fuel rails for reciprocating piston, spark-ignited internal combustion engines.

BACKGROUND OF THE INVENTION

In the past three decades, there have been major technological efforts to increase the fuel efficiency of automotive vehicles. One technical trend to improve fuel efficiency has been to reduce the overall weight of the vehicle. A second trend to improve fuel efficiency has been to improve the aerodynamic design of a vehicle to lower its aerodynamic drag. Still another trend is to address the overall fuel efficiency of the engine.

Prior to 1970, the majority of production vehicles with a reciprocating piston gasoline engine had a carburetor fuel supply system in which gasoline is delivered via the engine throttle body and is therefore mixed with the incoming air. Accordingly, the amount of fuel delivered to any one cylinder is a function of the incoming air delivered to a given cylinder. Airflow into a cylinder is effected by many variables including the flow dynamics of the intake manifold and the flow dynamics of the exhaust system.

To increase fuel efficiency and to better control exhaust emissions, many vehicle manufacturers went to port fuel injection systems, where the carburetor was replaced by a fuel injector that injected the fuel into a port which typically served a plurality of cylinders. Although port fuel injection is an improvement over the prior carburetor fuel injection system, it is still desirable to further improve the control of fuel delivered to a given cylinder. In a step to further enhance fuel delivery, many spark ignited gasoline engines have gone to a system wherein there is supplied a fuel injector for each individual cylinder. The fuel injectors receive their fuel from a fuel rail, which is typically connected with all or half of the fuel injectors on one bank of an engine. Inline 4, 5 and 6 cylinder engines typically have one bank. V-block type 6, 8, 10 and 12 cylinder engines have two banks.

One critical aspect of a fuel rail application is the delivery of a precise amount of fuel at a precise pressure. In an actual application, the fuel is delivered to the rail from the fuel pump in the vehicle fuel tank. At an engine off condition, the pressure within the fuel rail is typically 45 to 60 psi. When the engine is started, a typical injector firing of 2–50 milligrams per pulse momentarily depletes the fuel locally in the fuel rail. Then the sudden closing of the injector creates a pressure pulse back into the fuel rail. The injectors will typically be open 1.5–20 milliseconds within a period of 10–100 milliseconds.

The opening and closing of the injectors creates pressure pulsations (typically 4–10 psi peak-to-peak) up and down the fuel rail, resulting in an undesirable condition where the pressure locally at a given injector may be higher or lower than the injector is ordinarily calibrated to. If the pressure adjacent to the injector within the fuel rail is outside a given calibrated range, then the fuel delivered upon the next opening of the injector may be higher or lower than that preferred. Pulsations are also undesirable in that they can cause noise generation. Pressure pulsations can be exaggerated in a returnless delivery system where there is a single feed into the fuel rail and the fuel rail has a closed end point.

To reduce undesired pulsations within the fuel rails, many fuel rails are provided with added pressure dampeners.

Dampeners with elastomeric diaphragms can reduce peak-to-peak pulsations to approximately 1–3 psi. However, added pressure dampeners are sometimes undesirable in that they add extra expense to the fuel rail and also provide additional leak paths in their connection with the fuel rail or leak paths due to the construction of the dampener. This is especially true with new Environmental Protection Agency hydrocarbon permeation standards, which are difficult to satisfy with standard O-ring joints and materials. It is desirable to provide a fuel rail wherein pressure pulsations are reduced while minimizing the need for dampeners.

SUMMARY OF THE INVENTION

To make manifest the above-noted and other manifold desires, a revelation of the present invention is brought forth. In a preferred embodiment, the present invention provides a fuel rail for a plurality of fuel injectors. The fuel rail includes an elongated inlet tube which receives pressurized fuel. The inlet tube is encircled by an outer tube which forms a control volume enclosing the inlet tube. Fluid from within the inlet tube passes through an orifice into the outer tube. The outer tube is fluidly connected with the injectors via injector outlets.

The present invention provides a fuel rail which provides dampening characteristics which minimizes or eliminates any requirement for separate fluid dampeners to be added to the fuel rail.

Further features and advantages of the present invention will become more apparent to those skilled in the art after a review of the invention as it shown in the accompanying drawings and detailed description.

DETAILED DESCRIPTION OF THE INVENTION

Figure 1:
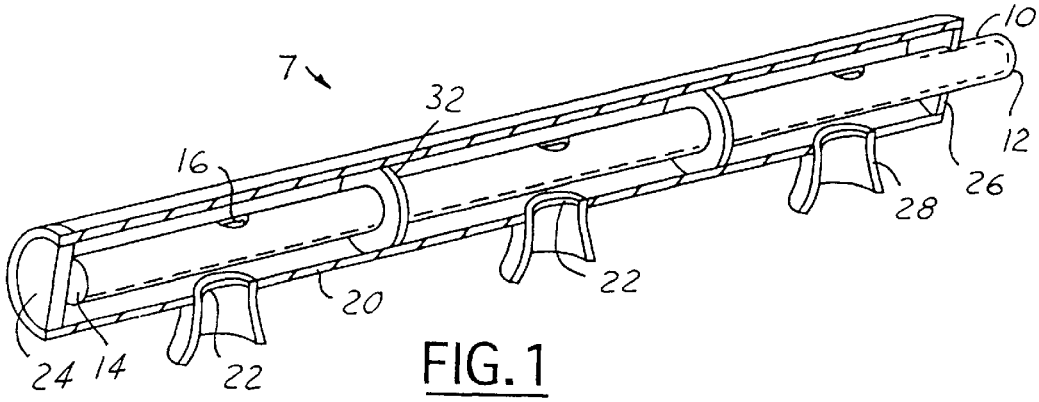
FIG. 1 is a sectional view of a preferred embodiment fuel rail according to the present invention.

Referring to FIG. 1, a fuel rail 7 according to the present invention is provided. The fuel rail 7 has a generally elongated inlet tube 10. The inlet tube has a first end 12 which is provided for the receipt of pressurized fluid therein. The inlet tube has an opposite blind end 14. The inlet tube has three generally geometrically spaced orifices 16. Enclosing the inlet tube 10 and forming a control volume thereabout, is an outer tube 20.

The outer tube 20 has three geometrically spaced injector outlets 22. The injector outlets 22 allow fluid within the outer tube 20 to communicate with a plurality of fuel injectors (not shown). The outer tube at its extreme ends has an installed plug 24. The outer tube 20 at its front end has an angular plug 26 which seals the interior of the outer tube 20 and seals against the exterior of the inlet tube 10. Fixedly connected by a press fit brazing, welding or other appropriate method to the outer tube 20 are three injector cups 28. Supporting the inlet tube 10 within the outer tube 20 are three annular baffle plates 32. The annular baffle plates 32 also function to bifurcate the interior of the outer tube 20 between the injector outlets 22. The orifices 16 of the inlet tube are oriented generally opposite the injector outlets 22 of the outer tube 20.

In operation, pressurized fluid is delivered to the inlet tube front end 12. Fluid then exits the inlet tube 10 through the orifices 16. Fluid flowing from the orifices 16 pressurizes the interior of the outer tube 20. The opening and rapid closure of the injector adjacent to the blind end 14 will cause a pressure pulsation. The pressure pulsation will be dampened due to several factors. One factor is a relatively large volume of fluid within the interior of the outer tube 20 adjacent to the injector outlet 22. Second, the orifice 16 acts as a convergent/divergent nozzle which further inhibits the propagation of pressure pulsations. Third, the baffle plate 32 inhibits the transmission of a pressure pulsation to the area within the outer tube 20 which is in the mid portion of the fuel rail 7. Fourth, the wall thickness of the inlet tube 10 can be fabricated to be materially thinner than the material utilized to fabricate the outer tube 20.

It has typically been found to be preferable that the volume of the fluid between the outer tube 20 and the inlet tube 10 between the two baffles 32 be at least equal to and preferably at least twice as large as the volume of the fluid within the inlet tube 10 between the two baffle plates 32.

Figure 2:
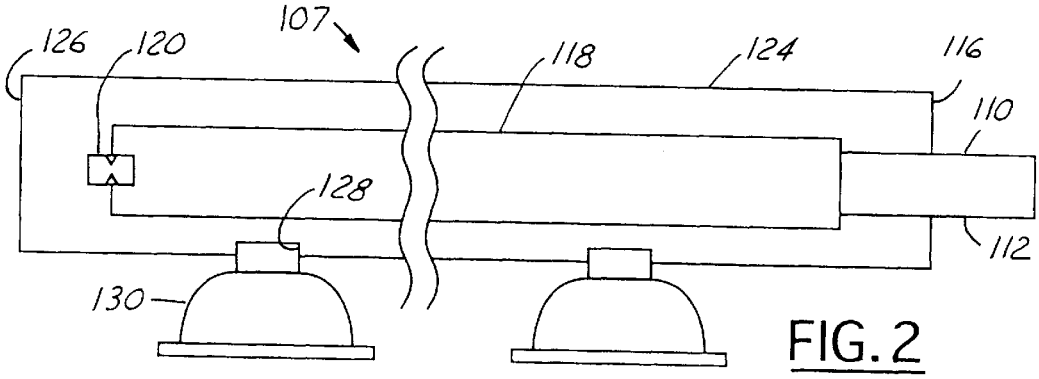
FIG. 2 is a sectional view of an alternate preferred embodiment fuel rail according to the present invention.

Referring to FIG. 2, an alternate preferred embodiment fuel rail 107 is provided. The fuel rail 107 has an inlet tube 110. The inlet tube 110 has a first portion 112 at its front end. The first portion 112 penetrates an end wall 116 of the fuel rail. The end wall 116 can optionally be made thick enough that it supports the inlet tube 110. Connected to the inlet tube first portion 112 is an inlet tube second portion 118. The inlet tube second portion 118 will typically be fabricated from a very thin wall low carbon or stainless steel having a thickness in the range of 0.005 to 0.020 inches. It is typically preferable for the inlet tube first portion 112 to be fabricated from a metal having a wall thickness materially thicker than the second portion 118 to allow the inlet tube first portion 112 to have strength in its connection to and penetration of the end wall 116. The wall thickness of the inlet tube 110 is also provided for attachment fluid fittings.

At an extreme opposite end on the inlet tube second portion 118, there is provided an orifice 120. The orifice 120 is sized so that there is generally a positive pressure differential between fluid within the inlet tube 110 and fluid which has escaped through the orifice 120 into an area adjacent to the inlet tube 110 outer diameter. The inlet tube 110 has an enclosed control volume formed thereabout by an outer tube 124. The outer tube 124 has its opposite end close by a blind end 126. The outer tube 124 has a series of injector outlets 128. Fixably connected to the outer tube 124 adjacent the injector outlets 128 are injector cups 130. Only two injector cups 130 are shown.

In other embodiments not shown, there will be three or four injector cups in total and in some cases even six. In the fuel rail shown in FIG. 2, the thin wall of the inlet tube second portion 118 is materially thinner than the wall of the outer tube 124 which will be in the neighborhood of thirty to forty-five thousands of an inch in thickness. Connecting brackets and associated hardware (not shown) will be fixably attached by brazing, welding or other suitable techniques to allow the fuel rail 107 to be connected to an internal combustion engine (not shown).

The thinness of the inlet tube second portion 118 allows it to deflect to dampen pulsations caused by the opening and closing of the injectors (not shown) associated with the various injector cups 130. The orifice 120 as previously mentioned is sized so that regardless of flow there through, a generally positive delta pressure is maintained between the fluid within the inlet tube 110 and the outer tube 124.

Figure 3:
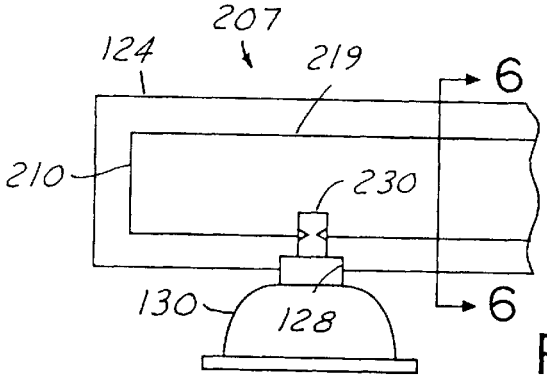
FIG. 3 is a partial sectional view of another alternate preferred embodiment of the present invention.
Figure 6:
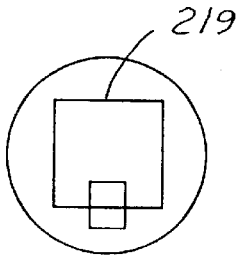
FIG. 6 is a view taken along lines 6—6 of FIG. 3.

Referring to FIGS. 3 and 6, another alternate preferred embodiment fuel rail 207 is provided. The inlet tube 219 is fabricated similar to prior inlet tube 118 except that it has a blind end in tube 110. Additionally, the inlet tube 219 has an orifice 230 which is adjacent to an injector outlet 128. This configuration provides an advantage in that the orifice 230 can be injected or inserted through the injector outlet 128. Additionally, to provide for more flexure to alleviate pressure pulsations the inlet tube 219 is given a polygonal cross sectional shape. In other embodiments (not shown), the inlet tube may be triangular or other various rectangular or polygonal shapes.

Figure 4:
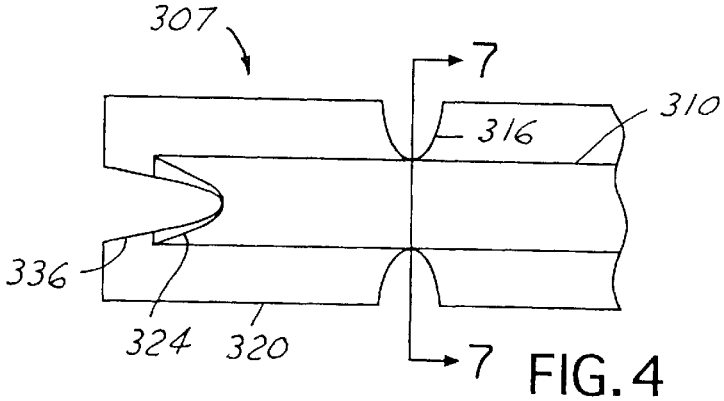
FIG. 4 is a partial sectional view of yet another alternate preferred embodiment of the present invention.
Figure 7:
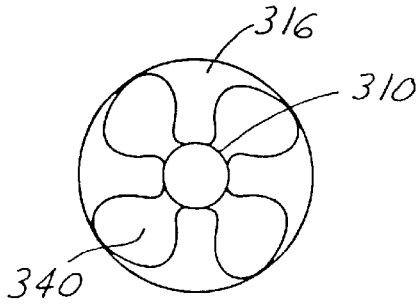
FIG. 7 is a view taken along lines 7—7 of FIG. 4.

Referring to FIGS. 4 and 7, a fuel rail 307 is provided. Fuel rail 307 has an inlet tube 310. The inlet tube 310 can be radially supported by supports 316 which are formed in an outer tube 320. Additionally, the inlet tube 310 has an inverse parabolic end 324. The outer tube 320 has stamped or formed supports 336 which axially support the inlet tube 310. The radial supports 316 have an almost flower shape providing opening 340 between the adjacent axial supports 336 to allow the free flow of fluid throughout the outer tube 320.

Figure 5:
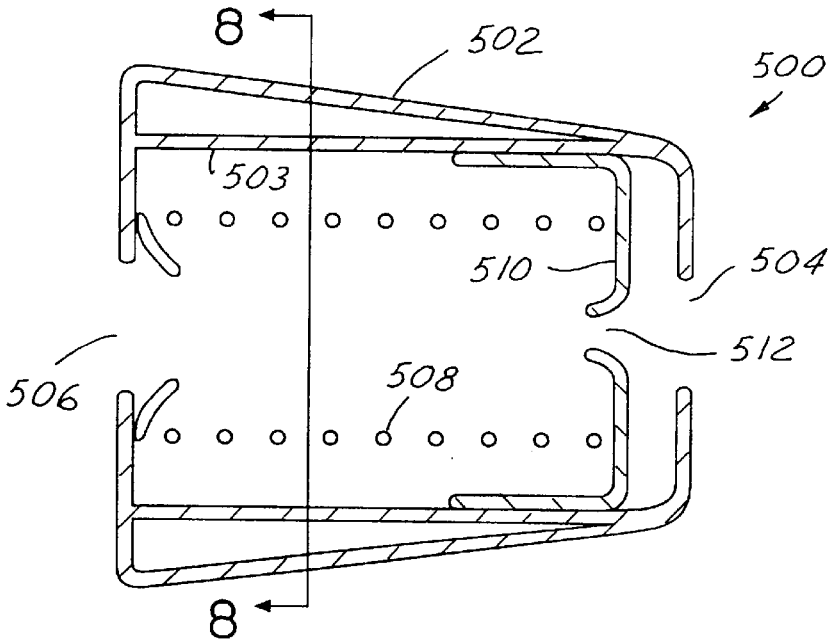
FIG. 5 is a sectional view of a positive pressure differential valve which can be utilized in an inlet orifice as shown in FIG. 1 or 2.
Figure 8:
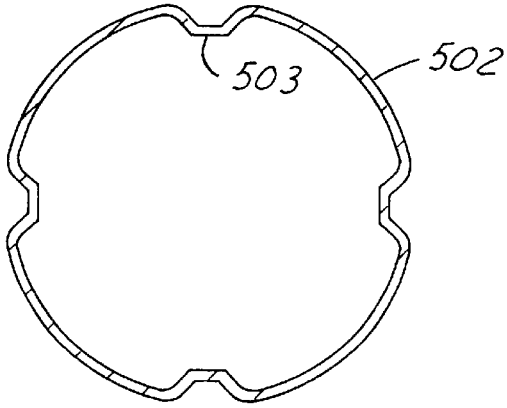
FIG. 8 is a view taken along lines 8—8 of FIG. 5.

Referring to FIGS. 5 and 8, a positive pressure differential flow valve 500 is provided which can be utilized in the fuel rails shown on FIGS. 1 through 4. Differential valve 500 has a body 502. The body 502 has integral stamped or added guides 503. The body 502 has an inlet orifice 504 and an outlet orifice 506. The body has an outward taper from the inlet orifice 504 to the outlet orifice 506. The length of guides 503 has a generally constant diameter.

Biased by spring 508 is a valve member 510, which is centered by the guides 503. The valve member 510 has a partial flow orifice 512. As the valve member moves towards the outlet orifice 506, an increased flow area exists between the valve member 510 and the valve body 502.

When an injector opens, the flow of fluid to the injector through one of the damper outlets causes a lowering in pressure in the outlet 506 causing the valve member 510 to be urged against the biasing of spring 508. Upon closing of the solenoid valve, fluid pressure at the outlet 506 will increase, urging the valve member 510 to reposition itself rightwardly. The positive pressure differential valve 500 functions to preserve a condition wherein there is a positive pressure differential between the fluid pressure at the inlet 504 versus the outlet 506.

While preferred embodiments of the present invention have been disclosed, it is to be understood that they have been disclosed by way of example only in that various modifications can be made without departing from the spirit and scope of the invention as it is explained by the following claims.

What is claimed is:

1. A fuel rail for delivering fuel to a plurality of fuel injectors for a reciprocating piston internal combustion engine, comprising:

an elongated inlet tube for receiving pressurized fuel, said inlet tube having at least one orifice;

an outer tube forming an enclosing control volume about said inlet tube, said outer tube having a plurality of injector outlets connected with an injector cup; and wherein said inlet orifice is sized to generally maintain a generally positive delta pressure between the fluid within said inlet tube and the fluid within said outer tube.

2. A fuel rail as described in claim 1, wherein said inlet tube has a plurality of orifices.

3. A fuel rail as described in claim 1, having an injector cup connected with one of said injector outlets of said outer tube.

4. A fuel rail as described in claim 3, wherein said orifice on said inlet tube is oriented in a direction generally opposite from an injector outlet on said outer tube.

5. A fuel rail as described in claim 1, having a baffle plate within said outer tube bifurcating said outer tube between injector outlets.

6. A fuel rail as described in claim 5, wherein said baffle plate supports said inlet tube.

7. A fuel rail as described in claim 1, wherein said inlet tube has a blind end.

8. A fuel rail as described in claim 1, wherein said fuel rail is a single pass-type fuel rail.

9. A fuel rail as described in claim 1, wherein said inlet tube is made from material thinner than said outer tube.

10. A fuel rail as described in claim 9, wherein said inlet tube has a first portion which is generally thicker for penetrating a wall of said fuel rail and a second portion materially thinner than said first portion.

11. A fuel rail as described in claim 1, wherein said inlet tube has a polygonal cross-sectional shape.

12. A fuel rail as described in claim 1, wherein said inlet tube has a single orifice.

13. A fuel rail as described in claim 1, wherein said orifice of said inlet tube is adjacent an injector outlet orifice of said outer tube.

14. A fuel rail as described in claim 1, wherein said inlet tube orifice has a valve to maintain a generally positive delta pressure between fluid within said inlet tube and fluid within said outer tube regardless of a flow rate of said fuel.

15. A fuel rail as described in claim 1, wherein a portion of said inlet tube is supported by a support formed in said outer tube.

16. A fuel rail as described in claim 15, wherein said support radially supports said inlet tube.

17. A fuel rail as described in claim 15, wherein said support of said outer tube axially supports said inlet tube.

18. A fuel rail for delivering fuel to a plurality of fuel injectors for a reciprocating piston internal combustion engine comprising:

an inlet tube having a wall thickness of a first thickness and having an orifice for generally regulating a pressure differential between fluid within said inlet tube and fluid without said inlet tube;

an outer tube enclosing said inlet tube and forming a control volume thereabout, said outer tube having a plurality of injector outlets exposed to said inlet tube orifice and said outer tube being fabricated from a material of a second thickness materially greater than said first thickness; and wherein a thinness of said inlet tube wall allows said inlet tube to deflect to dampen pressure pulsations.

19. A method of delivering fuel to a plurality of fuel injectors for a reciprocating piston internal combustion engine comprising:

delivering pressurized fuel to an elongated inlet tube;

forming a control volume about said inlet tube by enclosing said inlet tube with an outer tube;

fluidly communicating fluid from said inlet tube to an area within said outlet tube through an orifice in said inlet tube;

fluidly communicating fluid within said outer tube to a plurality of fuel injectors through a plurality of injector outlets; and sizing said inlet tube orifice to maintain a generally positive delta pressure between fluid within said inlet tube and fluid within said outer tube.

20. A method as described in claim 19, further including dampening pulsation caused by fluid flowing through said injector outlets by flexuring a thin wall of said inlet tube.

21. A fuel rail for delivering fuel to a plurality of fuel injectors for a reciprocating piston internal combustion engine, comprising:

an elongated inlet tube for receiving pressurized fuel, said inlet tube having at least one orifice;

an outer tube forming an enclosing control volume about said inlet tube, said outer tube having a plurality of injector outlets;

and wherein said inlet tube orifice has a valve to maintain a generally positive delta pressure between fluid within said inlet tube and fluid within said outer tube regardless of a flow rate of said fuel.

22. A fuel rail for delivering fuel to a plurality of fuel injectors for a reciprocating piston internal combustion engine, comprising:

an elongated inlet tube for receiving pressurized fuel, said inlet tube having at least one orifice; and an outer tube forming an enclosing control volume about said inlet tube, said outer tube having a plurality of injector outlets, and a portion of said outer tube forming a support for said inlet tube.

23. A fuel rail as described in claim 22, wherein said inlet tube orifice is sized to generally maintain a generally positive delta pressure between fluid within said inlet tube and fluid within said outer tube.

* * * * *